US005509759A

United States Patent [19]

Keesling

[11] Patent Number: 5,509,759

[45] Date of Patent: Apr. 23, 1996

[54] PRESTRESSED CONCRETE PILING

[76] Inventor: Klinton H. Keesling, 615 Dupont St., Punta Gorda, Fla. 33951

[21] Appl. No.: 422,885

[22] Filed: Apr. 17, 1995

[51] Int. Cl.[6] ..... E02D 5/30; E02D 5/58

[52] U.S. Cl. ..... 405/232; 249/118; 249/119; 425/111; 425/219; 425/432; 404/103; 404/105

[58] Field of Search ..... 249/118, 119; 425/111, 219, 432; 405/232; 404/103, 105, 117

[56] References Cited

U.S. PATENT DOCUMENTS

| | | | |
|---|---|---|---|
| 1,134,653 | 4/1915 | Weed | 249/118 |
| 1,585,421 | 5/1926 | Schneider | 249/119 |
| 2,445,894 | 7/1948 | Troiel | 249/118 |
| 2,950,660 | 8/1960 | Strandfuss | 404/103 |
| 3,685,934 | 8/1972 | Huber et al. | 425/111 |
| 3,833,706 | 9/1974 | Edwards | 425/111 |
| 4,194,405 | 3/1980 | Reynolds | 404/103 |
| 5,035,592 | 7/1991 | Lowndes, III et al. | 425/432 |

FOREIGN PATENT DOCUMENTS

| | | | |
|---|---|---|---|
| 630774 | 11/1961 | Canada | 425/111 |
| 0646848 | 4/1979 | U.S.S.R. | 249/119 |

OTHER PUBLICATIONS

Handbook of Concrete Engineering, 2nd Edition. Edited by Mark Fintel. 1985 by Van Nostrand Reinhold Co., Inc, pp. 314.

*Primary Examiner*—Ramon S. Britts
*Assistant Examiner*—Tara L. Mayo
*Attorney, Agent, or Firm*—Frank A. Lukasik

[57] ABSTRACT

A round , prestressed concrete pile having front and back flat portions and a method and apparatus for manufacturing the piles. The apparatus comprises essentially a plurality of horizontally placed piling molds and a concrete feeder and spreader. The concrete feeder and spreader are pulled across the pile molds by a spreader driver attached to a first end of the pile molds and the piles are removed from the pile molds by a cable tensioner and piling extractor attached to a second end of the pile molds. The piles are prestressed with flexible cable, wrapped with concertina wire, and embedded in concrete poured into the pile molds. The piles may be cast in different lengths by utilizing a bucket mold on the lower end.

6 Claims, 14 Drawing Sheets

PRESTRESSED CONCRETE PILING

BACKGROUND OF THE INVENTION

1. Field of the Invention

The invention relates generally to improved reinforced concrete pilings and more particularly to a round piling having front and back flat portions and a method of manufacturing the pilings.

2. Discussion of the Prior Art

Wood piles are subject to destruction by various causes and especially piles used in a marine environment where water and marine life are particularly destructive. To preserve wooden piles, various types of pre-treatment have been used, however, with the restrictions of environmental laws, several of the most effective preservatives have been banned.

Concrete piles are less destructible and, hence, are adapted to many conditions. Piles may be driven by the drop hammer or steam hammer methods. The steam hammer, with its comparatively light blows delivered in rapid succession, is of advantage in a plastic soil, the speed with which the blows are delivered acting to prevent the readjustment of the soil. It is also of advantage in soft soils where the driving is easy, but a light hammer may fail to drive a heavy pile satisfactorily. A water jet is sometimes used in sandy soils. Water supplied under pressure at the point of the pile through a pipe or hose run alongside it erodes the soil, allowing the pile to settle into place. To have full capacity, jetted piles are driven after jetting stops.

Piles may obtain their supporting power from friction on the sides or from bearing at the point. In the latter case, the bearing power may be limited by the strength of the pile, considered as a column, to which, however, the surrounding soil affords some lateral support. In the former case, no precise determination of the bearing power can be made.

Concrete piles may be divided into two classes, those which are molded in place and those which are pre-cast, cured and driven. Piles of both types, longer than 100 feet, have been driven. In one well known pile of this type, a thin sheet is fitted over a tapered mandrel before driving. This shell, which is left in the ground when the mandrel is withdrawn, is filled with concrete. Another well known pile of the molded-in-place type uses a hollow cylindrical mandrel which is filled with concrete after having been driven to the desired depth and raised a few feet at a time, the concrete flowing out of the bottom and filling the hole in the earth. Pre-cast and molded-in-place piles may be reinforced with steel. Only steel-reinforced piles are of interest in this invention.

Several prior art inventions have tried several methods to cast reinforced piles, such as, for example U.S. Pat. No. 1,393,545 to Knuth discloses a concrete piling including a tube extending the entire length of the pile through which tube a stream of water may be forced to issue at the lower end of the pile. The piling is reinforced with a series of vertically disposed metallic rods. In order to adapt the construction for use in sheet piling by forming longitudinal, V-shaped grooves are opposing each other. The spaces are then filled with concrete in situ or wooden timbers are forced into the spaces to make the joints water proof.

U.S. Pat. No. 1,163,377 to Selfridge discloses a concrete pile form comprising a spirally wound paper tube arranged vertically and engaging at its bottom a conical metallic shoe which forms the driving point of the pile. A plurality of anchor rods extend up into the tube and become embedded in the concrete. The reinforcing rods are tied to the anchor rods to produce a stronger structure. Cast into and extending through the shoe is a conduit which opens at the bottom of the shoe. Arranged within the form and connected to the conduit is a pipe which projects through the paper tube adjacent its upper end, the tube being provided with reinforcement at the point at which the pipe passes through. When the pile is being driven, water is forced through the pipe to loosen the earth in advance of the pile.

U.S. Pat. No. 1,165,134 to Schlueter discloses a pile consisting of a shaft, a head, and a continuous groove being formed along the inner side of the column having an enlarged area near the base. Longitudinal reinforcing rods are vertically located in the column and are tied together at suitable intervals by horizontal ties. The horizontal tie consists of a long member running around outside of all of the vertical reinforcements and a series of short rods and tying the vertical reinforcements together in pairs.

U.S. Pat. No. 4,317,543 to Miller discloses a reinforced concrete pile having a plurality of steel reinforcing cables and at least one ferrous metal alloy electrically conductive rod per cable which permits severing by oxygen cutting or electric arc welding.

SUMMARY OF THE INVENTION

This invention relates to a round, reinforced concrete piling, having front and back flat portions and a method and apparatus for manufacturing the pilings. The apparatus for casting the piles comprises essentially a plurality of horizontally placed piling molds and a concrete feeder and spreader. The concrete feeder and spreader are pulled across the piling molds by a spreader driver attached to a first end of the piling molds, and the piles are removed from the pile molds by a cable tensioner and piling extractor attached to a second end of the piling molds. The piles of this invention are prestressed with flexible cable (wire rope), wrapped with concertina wire, and embedded in concrete poured into the piling molds. The piles may be cast in different lengths by utilizing a bucket mold on the lower end. The resulting pile contains two round side surfaces and two flat side surfaces.

The primary use of the piles manufactured in accordance with the invention is in the building of piers and boat lifts. The two flat surfaces facilitate the installation of rub rails or other boat protective surfaces after the pier is built and a better, closer fit to the side of the pier slab. The piles may be hammer driven or installed by water jet.

DESCRIPTION OF THE PREFERRED EMBODIMENTS

Figure 1:
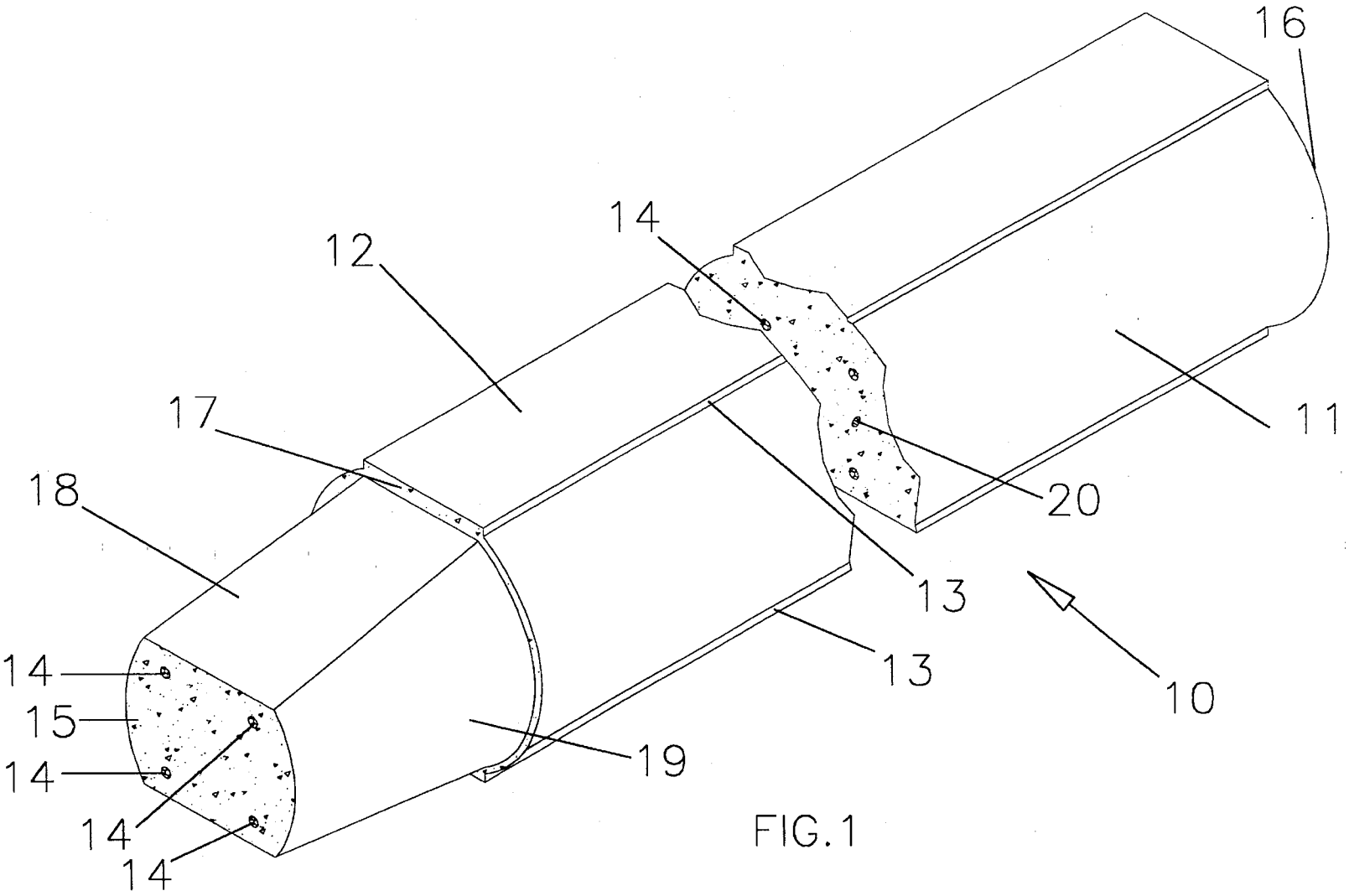
FIG. 1 is a perspective view, partially in section, of a piling in accordance with the present invention.
Figure 3:
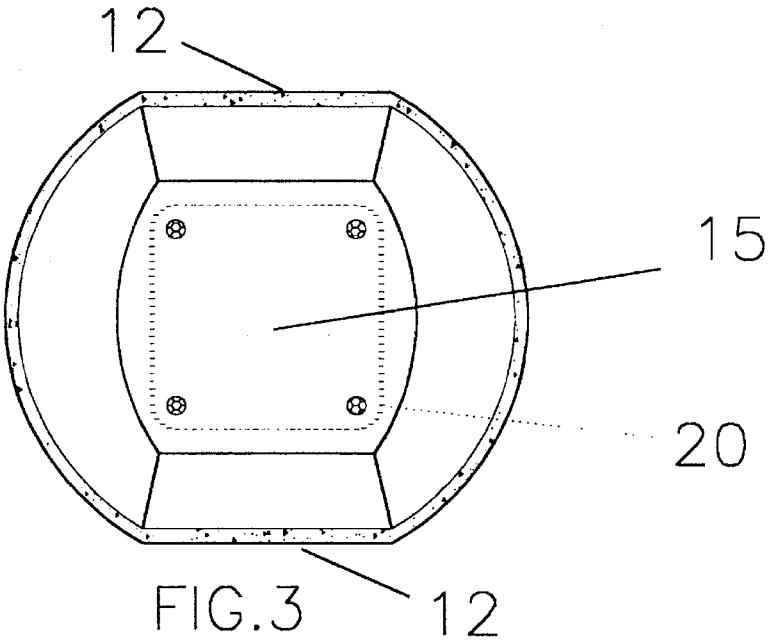
FIG. 3 is a bottom view of a pile in accordance with the invention.
Figure 2:
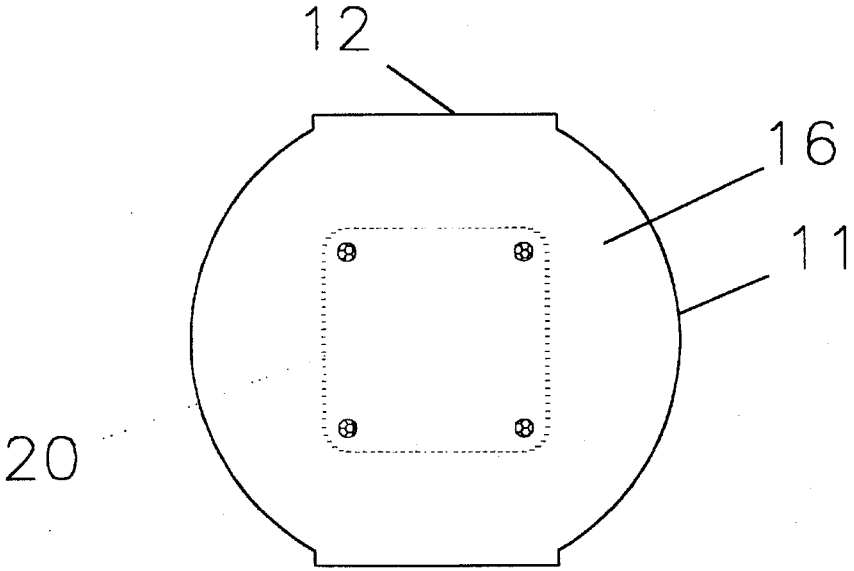
FIG. 2 is a top view of a pile in accordance with the invention.
Figure 4:
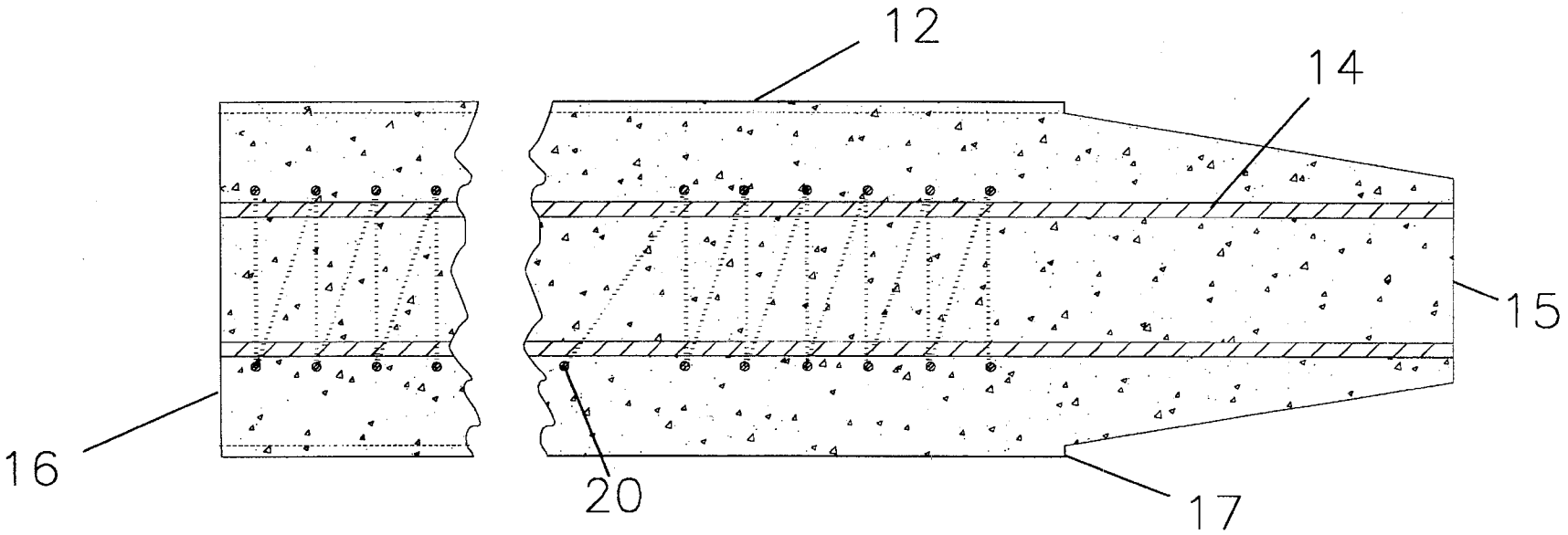
FIG. 4 is a side sectional view of a pile in accordance with the invention.

Referring to the drawings, which are for illustrative purposes only: FIG. 1 is a perspective view, partially in section, of a pile in accordance with the present invention, and designated by the numeral 10. FIGS. 2–5 show additional views of the pile from several angles.

The shape of the pile 10 consists of round side surfaces 11, flat side surfaces 12, and flat ridges 13. Flexible cable 14 (wire rope) is prestressed and runs through the pile 10 from the bottom surface 15 to the top surface 16. The bottom end of pile 10 is formed by bucket mold 21. The various surfaces of the bottom of pile 10 are formed by the corresponding surfaces of the bucket mold 21 and are indicated by the numeral with a prime (') designation. Flat bottom ridge 17, bottom angled flat surface 18, and bottom angled curved surface 19, are formed by the surfaces on bucket mold 21. Bucket mold 21 may be placed in the appropriate position, (not shown) for the length of pile 10 desired. Piles made in accordance with this invention may be made in lengths up to and including twenty feet.

In a preferred embodiment, a typical section consisted of:

SECTION PROPERTIES:

| | |
|---|---|
| Nominal Pile Size: 10" Round | Area: 76.5 in. sq. |
| Approx. wt/ft = 80 lbs | S: 107 in. cu. |

SPECIFICATIONS:

Concrete: Min. Cylinder Strength at Release = 3900 psi
Min. Cylinder Strength at Driving = 6000 psi

STEEL:

Strand = ⅜" 270 ksi LO-LAX, ASTM A-416
Nominal Area = .085 in. sq. - Uncoated
Spiral = No. 5 GA. Hard Drawn Wire - Uncoated
STANDARD BUILDING CODE SECTION 1308.3
PRESTRESSED PILES Section 1308.3.1 Design: fpc = 700 psi (MIN.)
Typical Section: 4⅝" Strands fpc = 749 (ACTUAL)
Section 1308.3.3 Allow Stress: N (Agfc) = 68 Tons In setting up the prestressed flexible cable 14 in a preferred embodiment, the four cables 14 are spaced 1 13/16" from a center vertical line and 1 13/16" from a center horizontal line with the centers of the cables 14 approximately 3⅝" distant from each other. Concertina wire 20 is wrapped around the prestressed flexible cables 14 from end to end of the pile 10 top surface 16 and ending approximately one inch from the bottom surface 15. The wrap is started at a first end, starting at approximately one inch from top surface 16, with a first portion of five turns spaced at a one inch pitch between wraps. A second portion follows with six turns at a six inch pitch, and a third section at an eight inch pitch for the distance required for the selected length of pile 14 being fabricated. A fourth portion follows with six turns at a three inch pitch followed by a fifth and final portion of six turns at a three inch pitch to a point approximately one inch from the second end, bottom surface 15.

Flat surfaces 12 on each side of pile 10 are formed by the flat surface of concrete base 29, and the concrete feeder and spreader 22 as the pile 10 is being formed in the pile molds 23. Flat ridges 13 and flat bottom ridge 17 are formed by the thickness of the respective mold. The completed pile has a diameter of 10" between the round surfaces 11 and 174" between the flat side surfaces 12.

Figure 6:
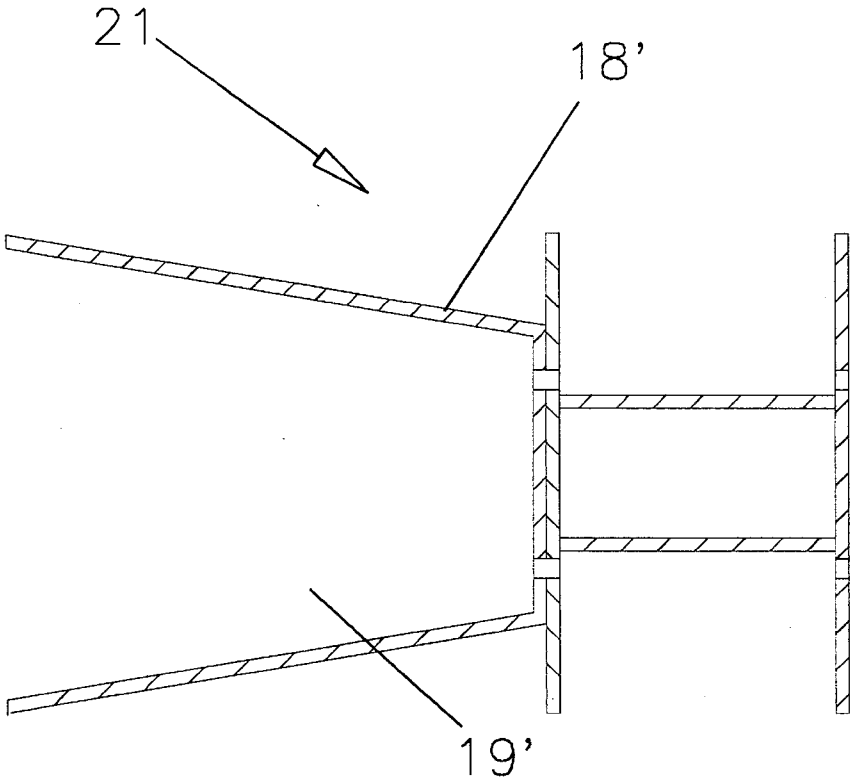
FIG. 6 is a side sectional view of a bottom point bucket mold in accordance with the invention.
Figure 5:
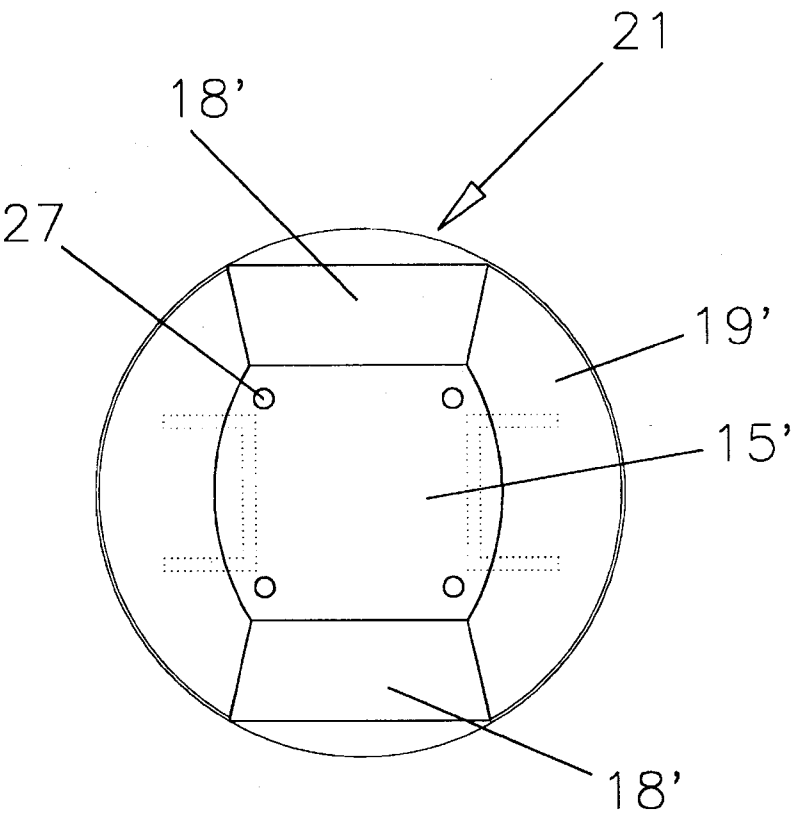
FIG. 5 is a top view of a bottom point bucket mold in accordance with the invention.

Bucket mold 21 shown in FIGS. 5 and 6 is used to provide a shaped, pointed end of pile 10 to facilitate the installation in its intended position. Bottom angled surfaces 18' provide the bottom angled flat surface 18, and bottom angled curved surface 19' provides bottom angled curved surface 19. Bottom surface plate 15' provides bottom surface 15. Bottom surface plate 15' also contains holes 27 through which flexible cable 14 are drawn through in assembly of pile 10. Bucket mold 21 may be located in any position in piling mold 23 depending on the desired length of the pile 10. In forming the pile 10, bucket mold 21 is inserted in the pile mold 23 in the appropriate position to determine the length of pile 10. The void around the two surfaces 18' and 19' may be stuffed with disposable material to fill the void and prevent concrete from filling the void.

Figure 7:
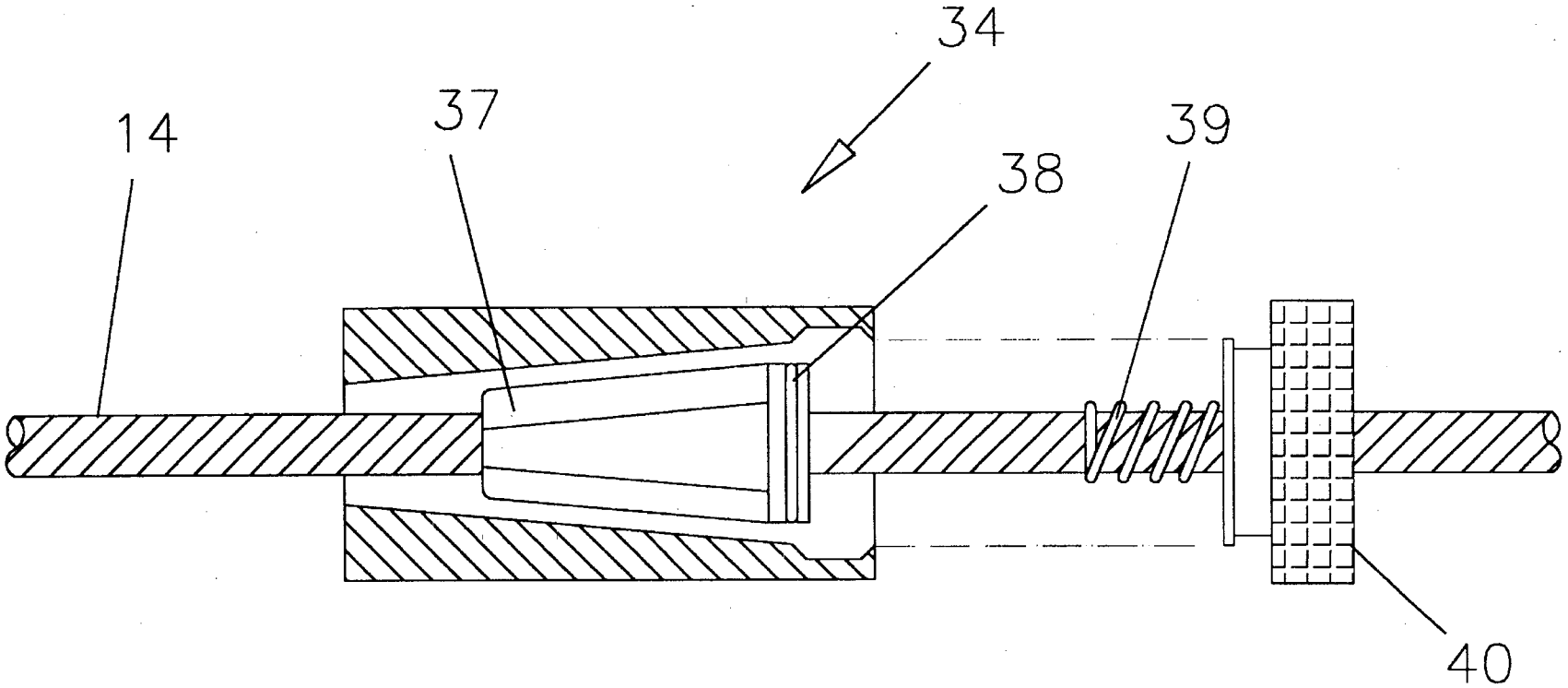
FIG. 7 is a sectional view of the reinforcing cable clamp.
Figure 8:
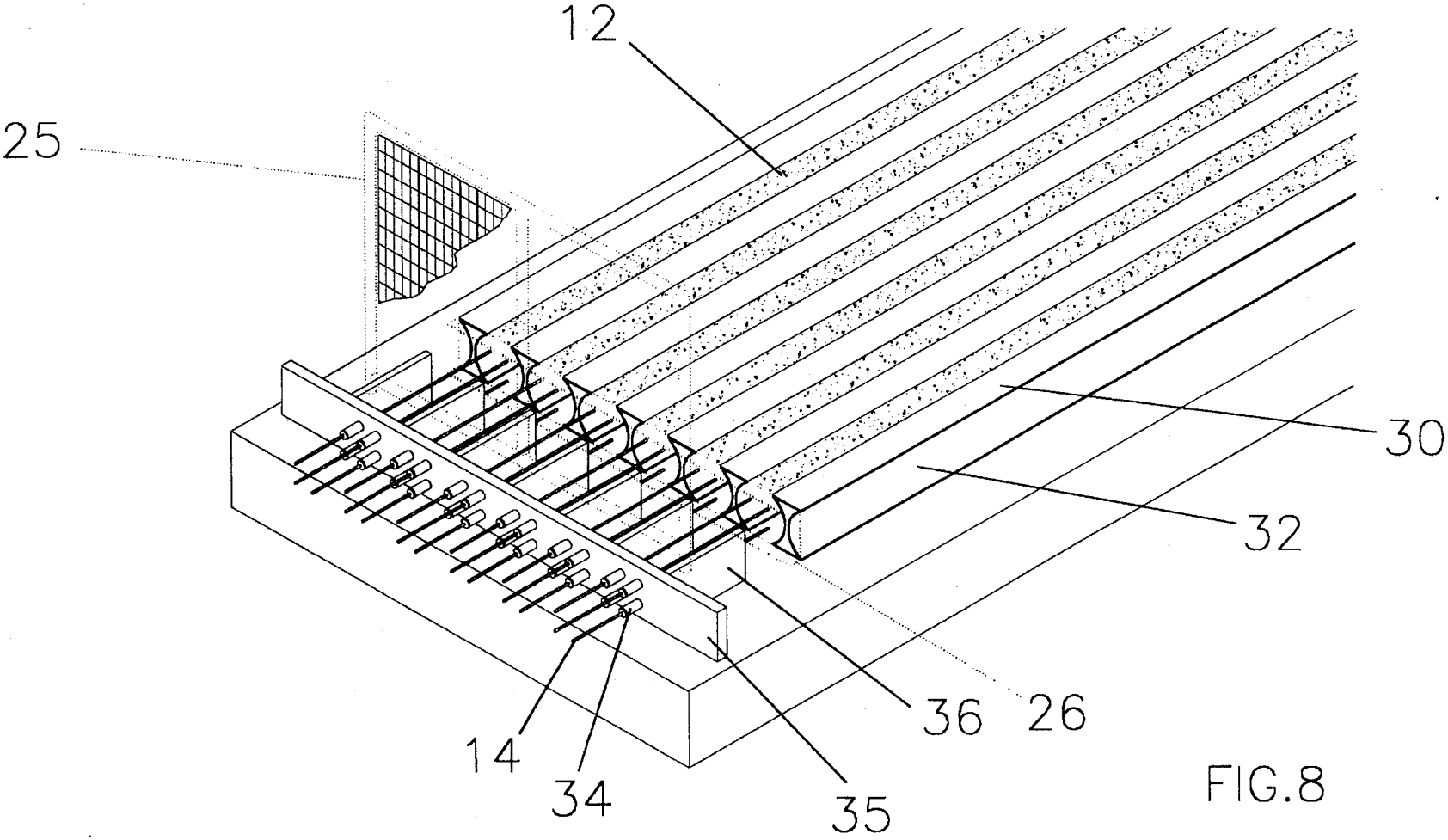
FIG. 8 is a perspective view of a section of the apparatus and fittings to clamp flexible cable.
Figure 9:
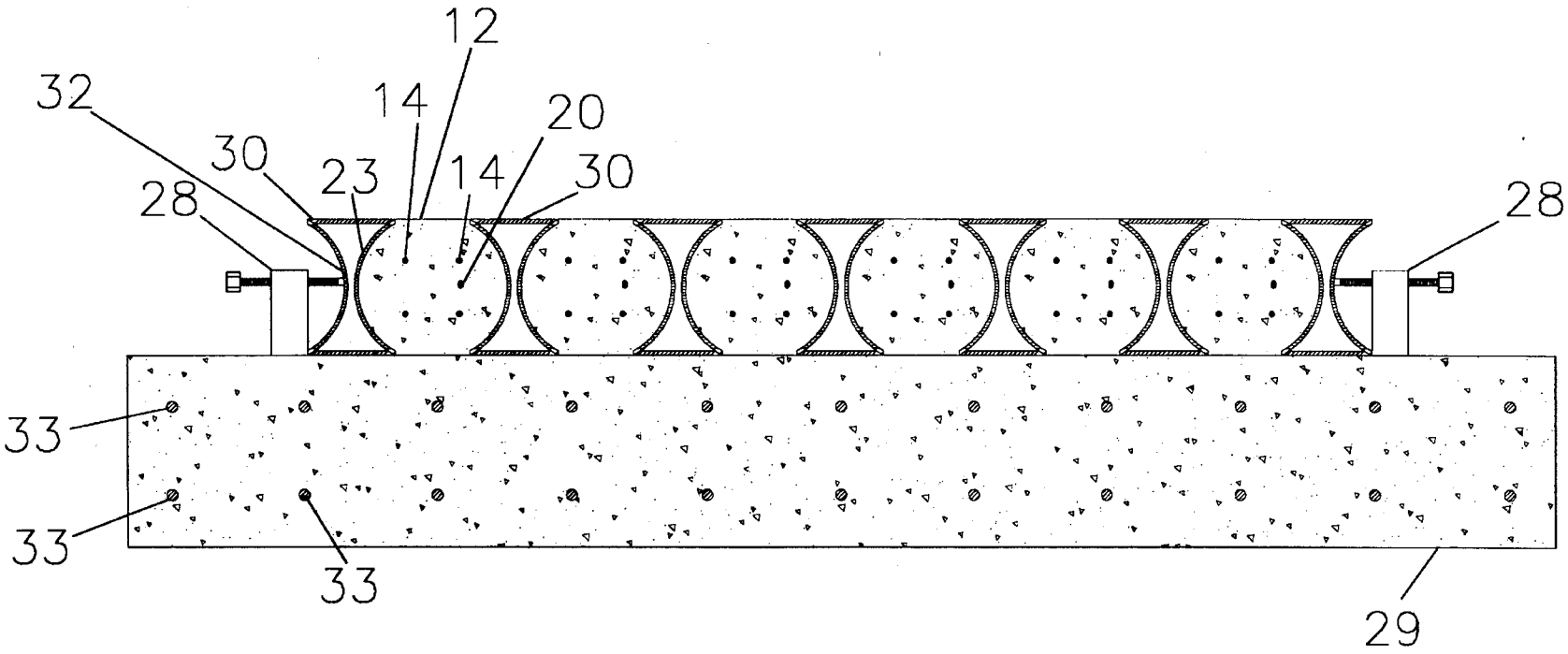
FIG. 9 is a front sectional view of the piling mold showing cast piles.
Figure 10:
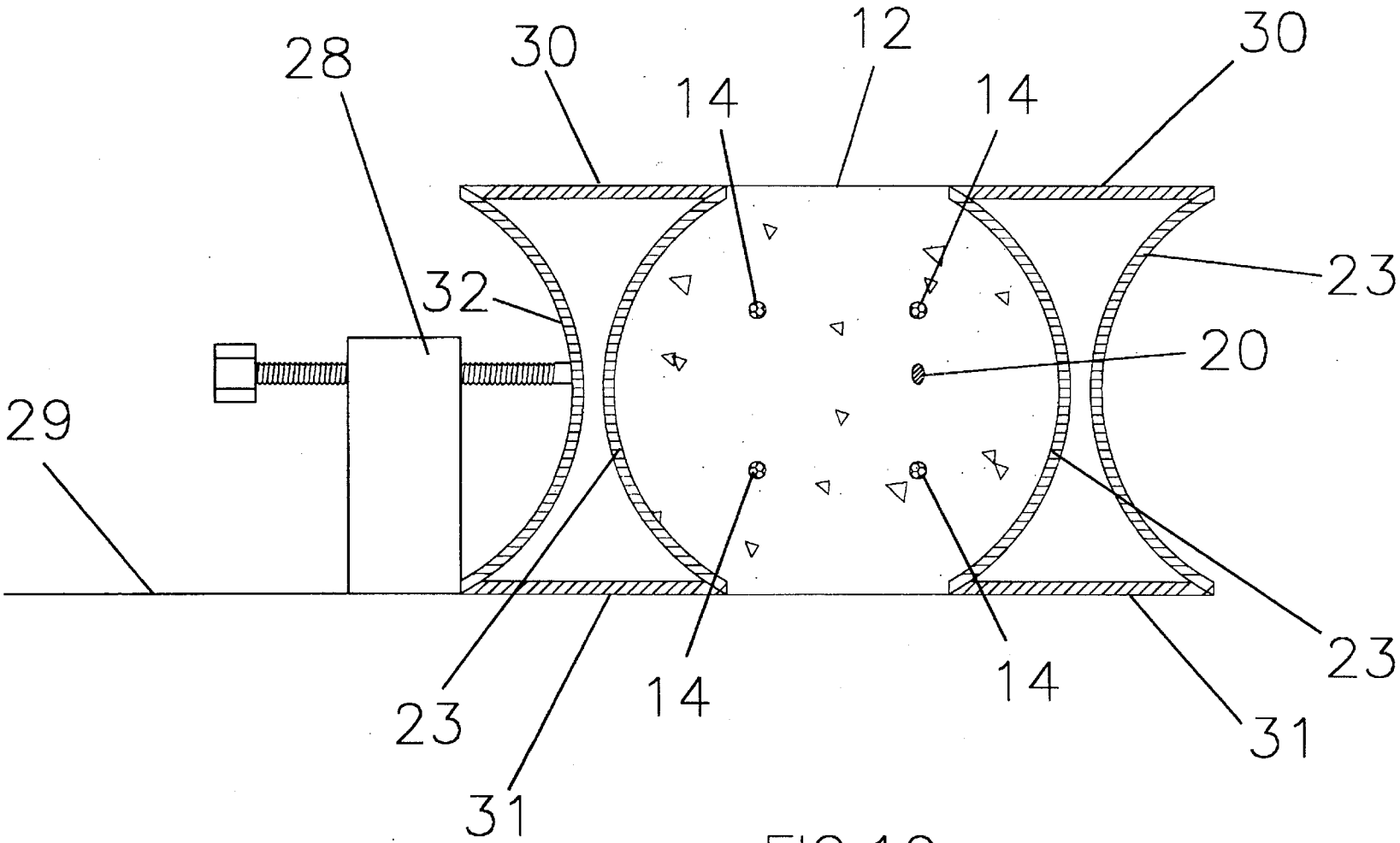
FIG. 10 is a front sectional view of a single pile shown inside the mold.
Figure 11:
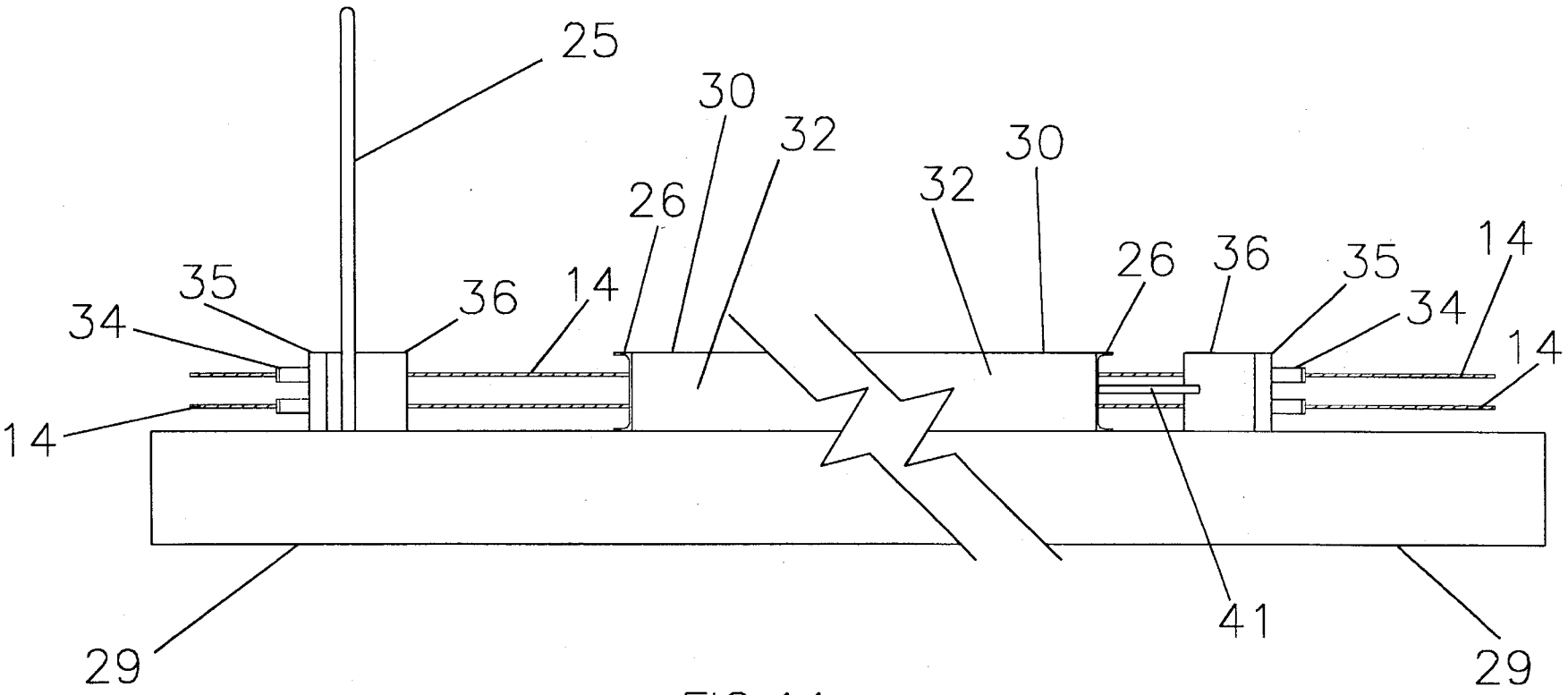
FIG. 11 is a side sectional view of the apparatus used to mold piles.

FIGS. 7 through 16 illustrate the apparatus used in the manufacture of the pile 10 of the invention. FIG. 8 is a perspective view of a section of the apparatus and cable clamps 34 to clamp flexible cable 14. Beginning from the left side of FIG. 11 there are shown base 29, a reinforced concrete slab with steel reinforcements 33. Affixed to base 29 are a series of parallel, hourglass shaped mold side plates 32 having mold top plate 30 and mold bottom plate 31 affixed thereto to form a solid side which in combination with the adjacent structure forming pile mold 23. The outermost mold side plates 32 are further supported by screw brace 28. The pile mold 23 cavity is closed at both ends by placing mold end plates 26 at the top and bottom ends of the pile mold 23. The top surface 16 end plate 26 is held in place by end brace 35 and end brace stop 36 when the flexible cable 14 is tensioned. End plate 26 is also placed against the lower end of the pile mold and held in place by end brace 35 and end brace stop 36 when the flexible cable 14 is tensioned. Bucket mold 21 is placed at the end of the pile mold 23 to form the bottom surface 15. A second bucket mold 21 is placed in the appropriate position in pile mold 23 when shorter piles 23 are being manufactured. Safety screen 25 is placed at the end of base 29, the end which the tensioning device is attached, to protect any workmen who may be in the area in the case a cable 14 fails under tension. A unit such as piling extractor 65 may also be used to prestress cables 14.

Figure 15:
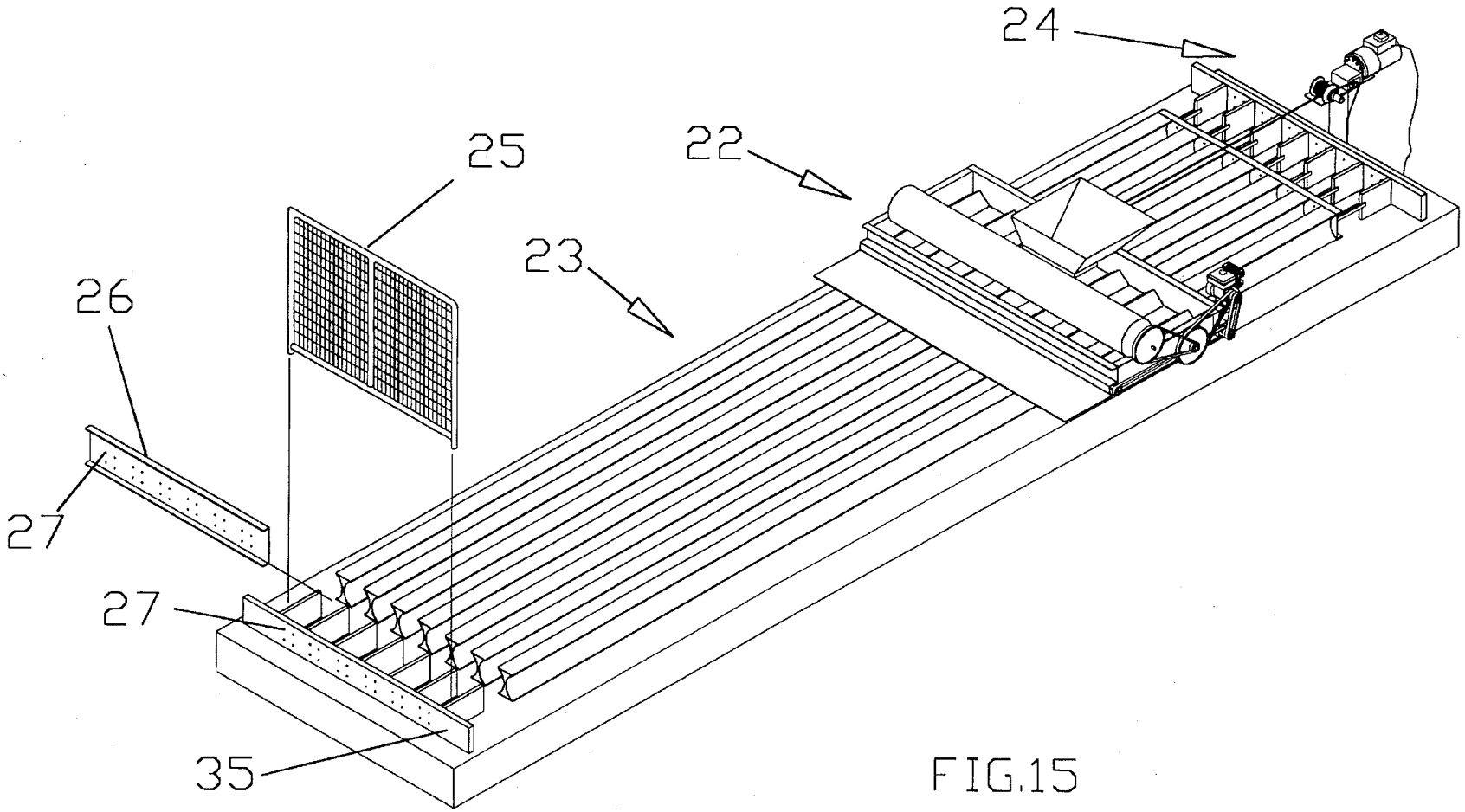
FIG. 15 is an overall perspective view of the pile mold apparatus showing the concrete spreading device and an exploded view of the safety barrier and pile mold end plate.
Figure 16:
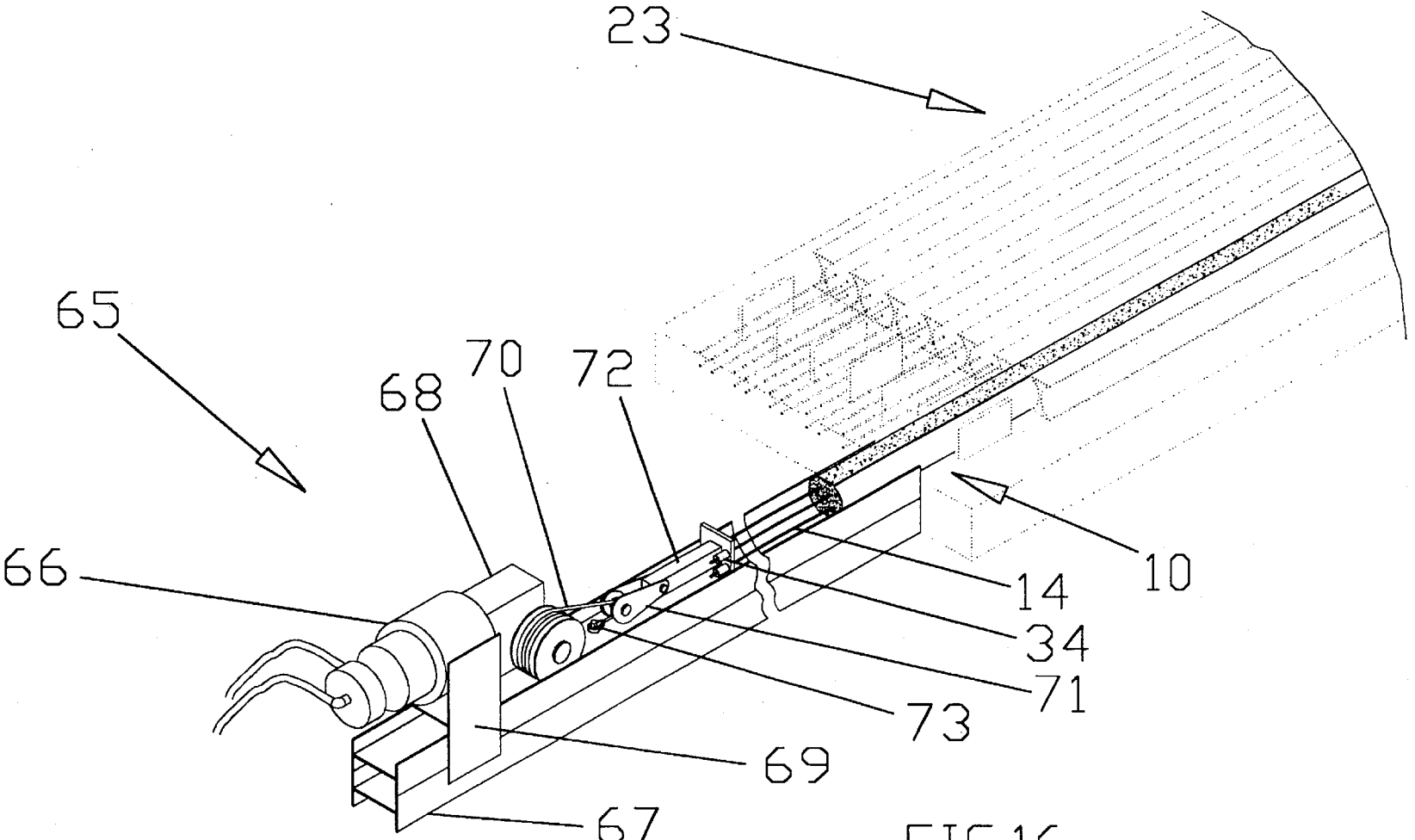
FIG. 16 is a perspective view of an extractor apparatus used in the process of fabricating a pile in accordance with the invention.

In preparation for manufacturing piles 10, the apparatus as shown in FIG. 15 is assembled. Mold end plates 26 are placed at the top surface end 16 of piling mold 23 and bottom surface end 15 of piling mold 23. End brace 35, is positioned with end brace stop 36 abutting mold end plate 26 at each end of pile molds 23. Flexible cables 14 are then strung through holes 27 located in each of the end braces 35, mold end plates 26, and bucket molds 21 and along the entire length of pile molds 23. After tension is placed on flexible cables 14, concertina wire 20 is wrapped as described above and affixed to the cables 14 with wire ties (not shown) to keep the concertina wire 20 stationary, in the desired position, as the concrete mixture 59 is poured into pile molds 23.

FIG. 7 depicts a cable clamp 34 used to retain cables 14 in tension until the concrete mixture 59 sets. .Cable clamp 34 is slid over cable 14 and drawn up to mold end plate 26. Cable clamp 34 comprises split collar 37, rubber "O"-ring 38, tension spring 39, and locking cap 40. When the appropriate tension of cable 14 is reached, locking cap 40 is seated against split collar 37, which is wedged into clamp 34 and the cable 14 is held in its tensioned position. The process is repeated for each of the cables 14 for the desired number of piles being manufactured. Cable clamps 34 are also used on the opposite end of the cables 14 forming the bottom surface 15 of the pile 10. Braces 41 are used to provide the bearing contact of end brace 35 with mold end plate 26. FIG. 8 shows the mold end plate 26 (in dotted lines) prior to engagement with end brace stops 36 of end brace 35. Cable clamps 34 are also shown fitted on cables 14.

Figure 12:
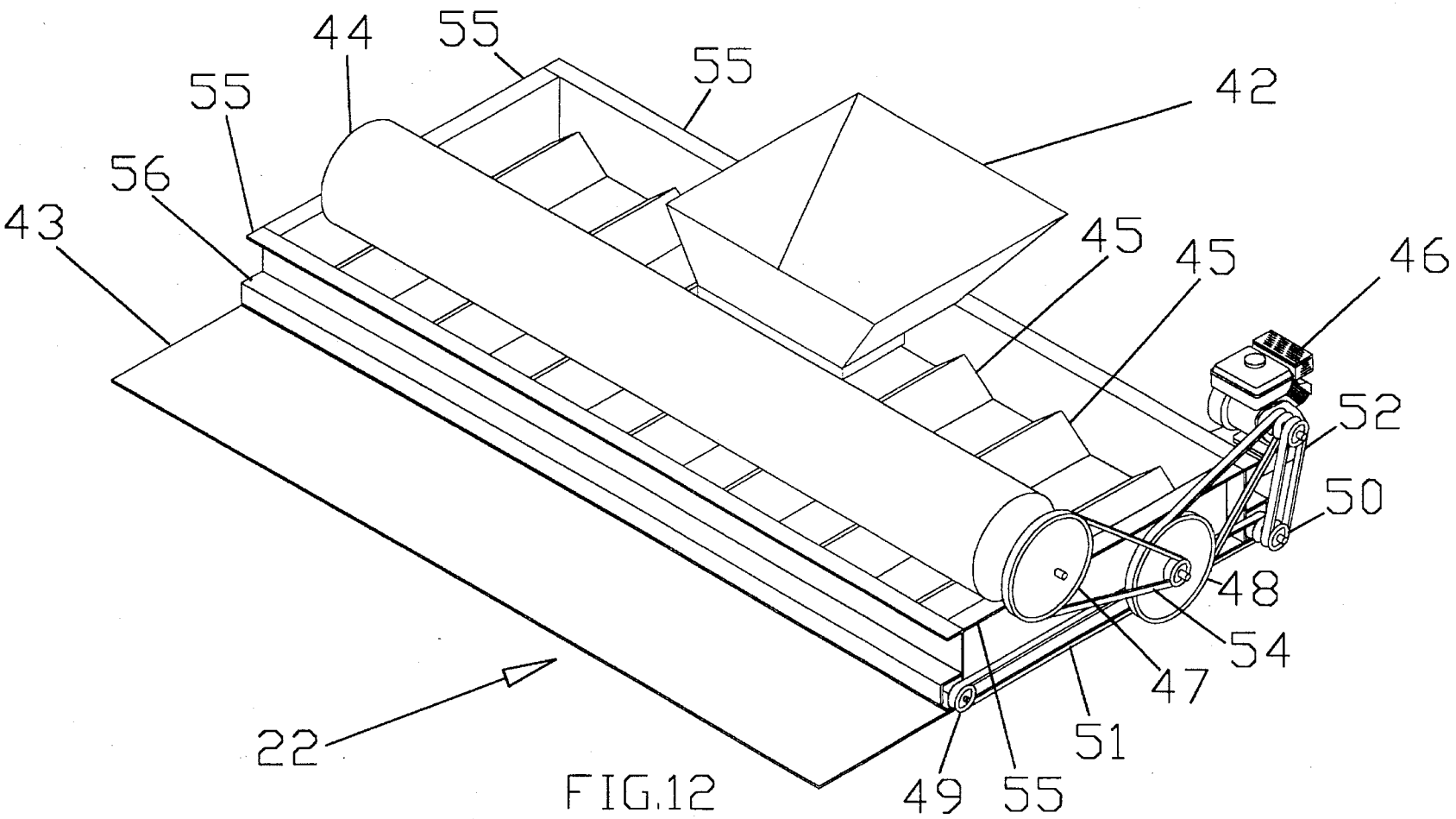
FIG. 12 is a perspective view of an apparatus used to spread concrete into pile molds.
Figure 13:
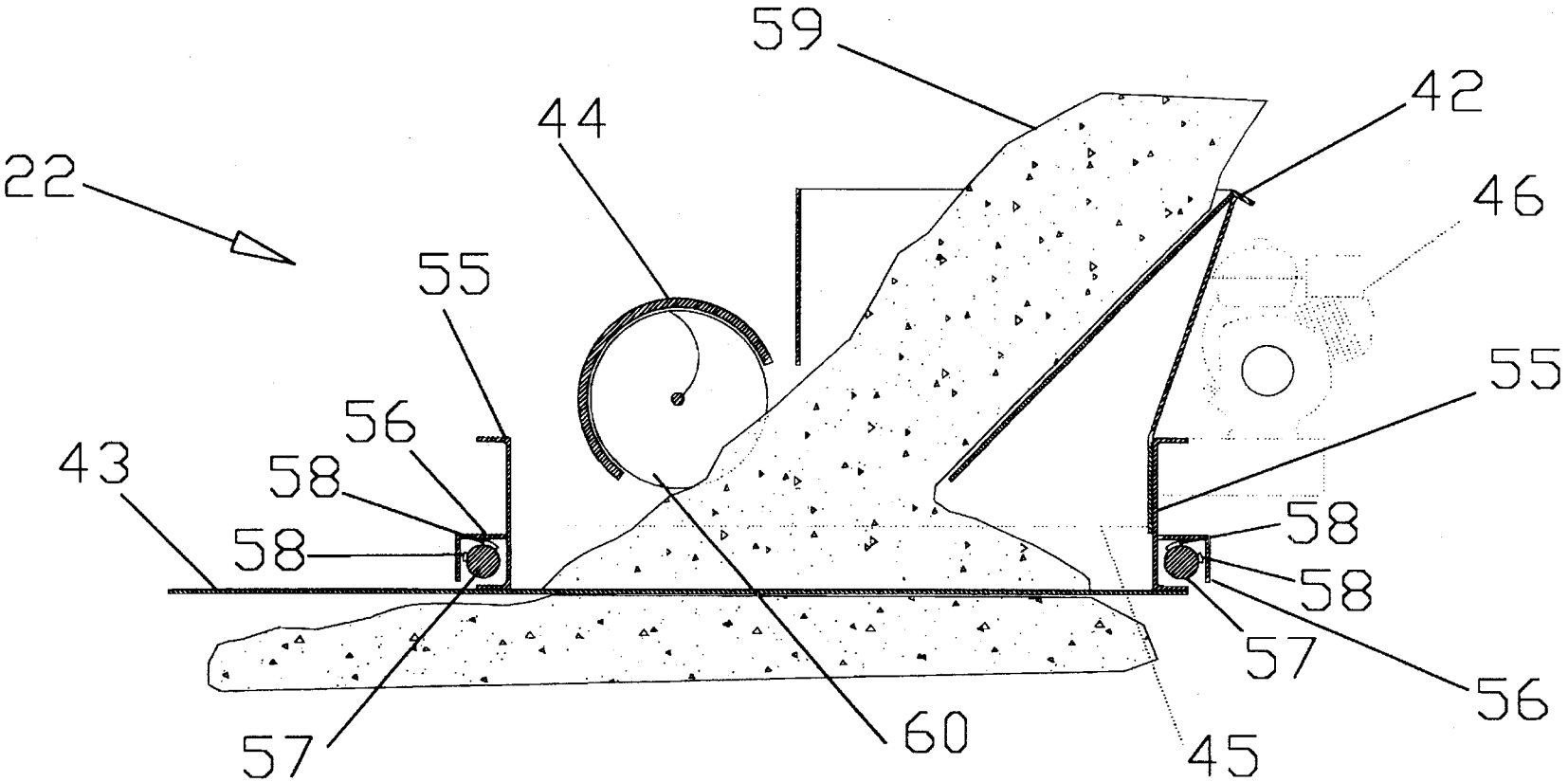
FIG. 13 is a sectional view of a concrete spreader apparatus.
Figure 14:
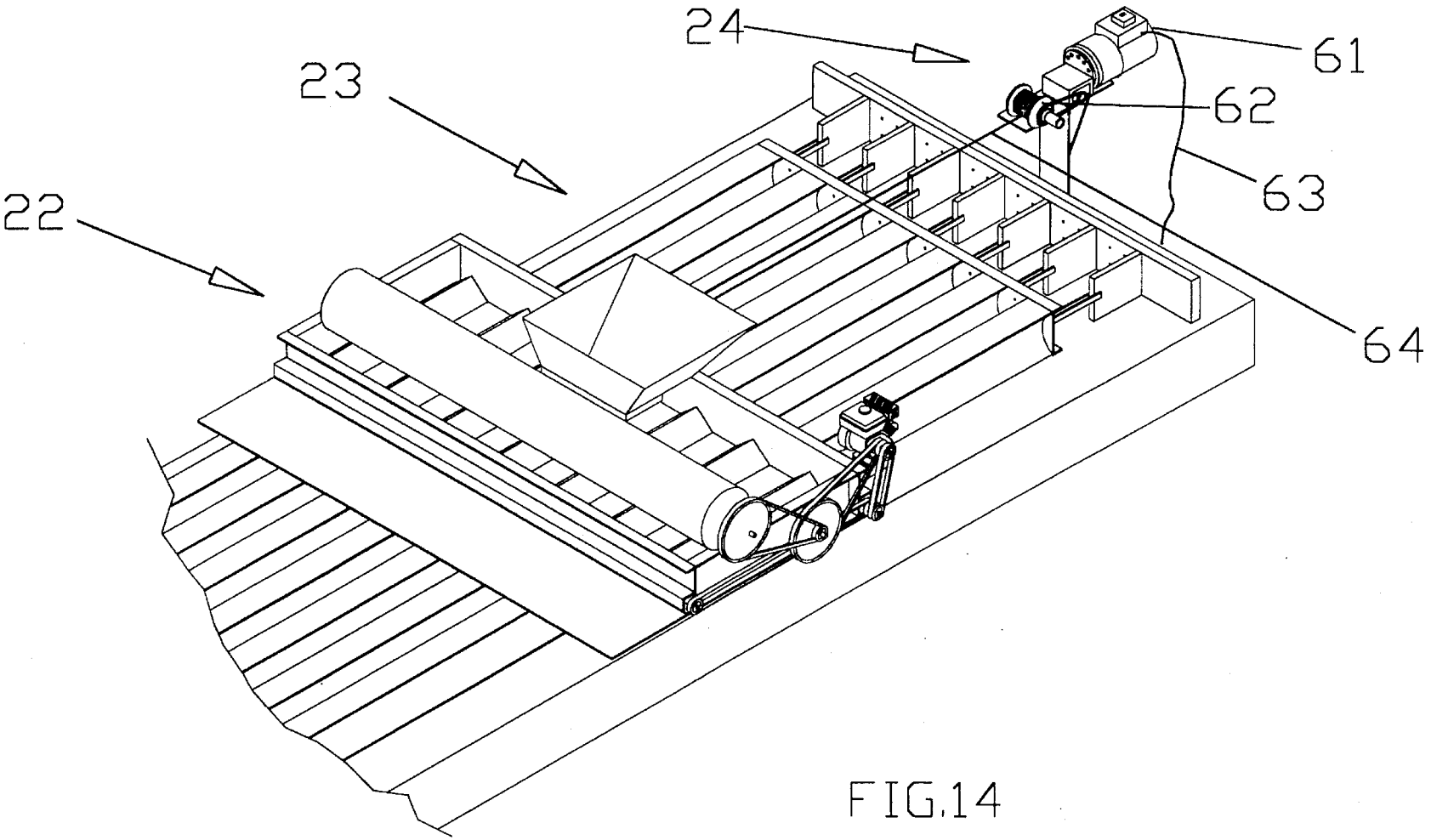
FIG. 14 is a perspective view of the piling mold apparatus with the concrete spreader and pulling device in place.

FIGS. 12 and 13 depict an apparatus to spread the concrete mixture 59 into pile molds 23. The concrete feeder and spreader 22 of the invention comprises a channel frame 55, concrete hopper 42, a feeder base plate 43, a spreader safety guard 44, a concrete guide 45, a gasoline engine 46, spreader drive pulley 47, transfer pulley 48, front vibrator shaft pulley 49, rear vibrator shaft pulley 50, secondary drive belt 51, and primary vibrator drive belt 52, Spiral spreader blade 60 is driven by spreader drive pulley 47 driven by secondary transfer belt 54.

Vibrator shafts 57 have eccentric weights 58 affixed thereto and are rotated by gasoline engine 46. Vibrator guards 56 are affixed to channel frame 55 and cover the upper surface to prevent accidental contact and potential injury. When the vibrator shafts 57 are rotated, the eccentric weights 58 contact the feeder base plate 43 and shake the piling molds 23 to settle the concrete mixture 59 within the molds 23. Spiral spreader blade 60, driven by spreader drive pulley 47, feeds the concrete mixture 59 into the slots formed between the concrete guides 45.

In operation, spreader driver 24 is affixed to base 29. Concrete feeder and spreader 22 is placed at the top end (left) of pile molds 23. The interior surfaces of pile molds 23 are coated with a concrete release agent or oil to provide a non-stick surface for ease of removal of piles 23 after they have been cast. The spreader driver 24 comprises a feeder/driver puller motor 61, a winch 62, driven by the motor 61, and a flexible puller cable wire 64. Electric cable 63 provides power to the puller motor 61. Concrete mixture 59 is poured into concrete hopper 42, gasoline engine 46 is started and concrete feeder and spreader 22 is pulled across pile molds 23. As the concrete mixture 59 is fed into the pile molds 23, the constant vibration created by vibrator shafts 57 causes the concrete mixture 59 to settle into the pile molds 23 and fills any voids. As the concrete feeder and spreader 22 is pulled across the pile molds 23, feeder base plate 43 slides along the top surface of the concrete mixture in molds 23 and provides a troweling action to create a smooth flat side surface 12 on pile 10.

When the pile molds 23 are filled, the concrete feeder and spreader 22 is removed. After sufficient time has elapsed for the concrete mixture 59 to harden, the pile extractor 65 is set up at the top end (surface 16) and extractor chassis 67 is placed against the base 29. The piling extractor 65 comprises hydraulic motor 66, hydraulic winch 68, mounting plate 69, extractor cable 70, extractor cable winch block 71, extractor arm 72, and cable anchor 73. Extractor arm 72 is attached to the four flexible cables 14 of the first pile 16 to be extracted with cable clamps 34. Hydraulic pressure is applied to hydraulic motor 66 and the pile 16 is gradually extracted. After the pile 16 is extracted, the cable clamps 34 are removed and the excess lengths of cable are removed by cutting.

What is claimed is:

1. Apparatus for horizontally casting prestressed, concrete piles, said apparatus comprising:

a reinforced concrete base, a plurality of horizontally spaced pile mold side plates affixed to said concrete base, said side plates having, a first end and a second end, a mold cavity between each pair of said mold side plates, and a horizontal top opening for admitting a concrete mixture, at least one bucket mold positioned in each of said pile mold cavities for forming bottom surfaces of the concrete piles, removable end braces placed at each of said first and second ends, said end braces having a plurality of cable receiving holes formed therein, cable tensioning means for prestressing cables to be embedded in the concrete piles, concrete spreading means placed on said mold side plates for feeding and spreading the concrete into said mold cavities, and, spreader driving means affixed to said base and attached to said concrete spreading means for pulling said concrete spreading means across said mold side plates, and thereby filling said cavities with concrete.

2. Apparatus as claimed in claim 1, wherein said concrete spreading means comprises:

a base plate, a channel frame affixed to said base plate, a concrete hopper mounted on said channel frame, parallel, spaced, guides for directing concrete into said pile mold cavities, a spiral spreader blade rotatably mounted on said channel frame, vibrator means for vibrating said base plate and said mold side plates, and power means for driving said spreader blade and said vibrator means.

3. Apparatus as claimed in claim 1 wherein said pile mold side plates comprise a pair of curved side plates with curved sides facing inwardly and joined together at a top end by a mold top plate and at a bottom end by a mold bottom plate.

4. A method of casting prestressed, concrete piles in a cavity formed by a plurality of horizontally spaced pile mold plates affixed to a concrete base, said method comprising the steps of:

inserting steel cables in said cavity, said cavity having a bottom flat surface and a top open area, and two round side surfaces, suspending said cables within said cavity, prestressing said cables, wrapping said cables with concertina wire to form a square column along the entire length of the pile, spreading a parting agent on the inner surface of said cavity to prevent adherence by concrete, forming a lower surface with at least one bucket mold located in said cavity, feeding, spreading, and vibrating concrete into said cavity, thereby forming said pile, drying said concrete formed pile until hardened, extracting said pile from said cavity by pulling said cables, and cutting said cables at a top and bottom surface of said pile to remove excess cable.

5. A prestressed concrete pile molded in a cavity formed by a plurality of horizontally spaced pile mold plates affixed to a concrete base, said pile comprising:

four, prestressed cables running through the entire length, and spaced around the center of said pile to form a square shape relationship to each other, a square shaped coil of concertina wire expanded and wrapped around said four, prestressed cables, from a point near a top surface to a point near a bottom surface, and a concrete mixture embedding said cables and forming a top and bottom flat surface, two round side surfaces, two flat side surfaces, and a shaped, pointed end.

6. A prestressed concrete pile as claimed in claim 5 wherein said concertina wire wrap is started one inch from said top surface, with a first portion of five turns spaced at a one inch pitch between wraps, a second portion with six turns at a six inch pitch, and a third section at an eight inch pitch for the selected length of pile being fabricated, a portion with six turns at a three inch pitch followed by a fifth and final portion of six turns at a three inch pitch to a point one inch from said bottom surface.

* * * * *